United States Patent [19]

Hemmeter

[11] Patent Number: 4,487,359

[45] Date of Patent: Dec. 11, 1984

[54] AID FOR OPENING AND REOPENING OF FROZEN DESSERT BOXES

[76] Inventor: George T. Hemmeter, 4125 Black Point Rd., Honolulu, Hi. 96816

[21] Appl. No.: 497,111

[22] Filed: May 23, 1983

Related U.S. Application Data

[63] Continuation-in-part of Ser. No. 488,197, Apr. 25, 1983.

[51] Int. Cl.[3] ..... B65D 5/10; B65D 3/26

[52] U.S. Cl. ..... 229/39 R; 229/44 R; 206/628; 206/815

[58] Field of Search ..... 229/39 R, 37 R, 38, 229/17 R, 7 R, 44 R; 206/629, 627, 628, 633, 815, 621, 611, 608, 634

[56] References Cited

U.S. PATENT DOCUMENTS

| | | | |
|---|---|---|---|
| 1,960,947 | 5/1934 | Lauth et al. | 229/52 B |
| 1,962,492 | 6/1934 | Fallert | 229/37 R |
| 2,435,878 | 2/1948 | Dunning | 229/37 R |
| 2,782,980 | 2/1957 | Ruechert | 206/633 |
| 3,018,030 | 1/1962 | Schnee | 229/39 R |
| 3,092,298 | 6/1963 | Scholle | 229/39 R |
| 3,132,793 | 5/1964 | Osteen | 206/611 |
| 3,181,767 | 5/1965 | Starkey | 229/17 R |
| 3,206,102 | 9/1965 | Henry, Jr. et al. | 206/608 |
| 3,219,255 | 11/1965 | Holmes | 206/633 |
| 3,871,571 | 3/1975 | Cupo | 229/39 R |

*Primary Examiner*—Allan N. Shoap
*Assistant Examiner*—Bryon Gehman
*Attorney, Agent, or Firm*—George W. T. Loo

[57] ABSTRACT

An aid for opening and reopening of rectangular, frozen dessert boxes. The aid is a cut tab which is located in the outer edge portion of the innermost lid of the box. The cut tab includes a curved cut and a scoreline. The curved cut has a circumference of approximately ⅔ of a circle and has its ends connected to the scoreline. The scoreline is inclined at a predetermined angle with the side edge of the lid. The cut tab is located a predetermined distance from a corner and has an area which provides ample finger room for a finger opening. Opening instructions are printed in cut tab area. Another cut tab may be located near the opposite corner of the lid with its scoreline similarly inclined as the other cut tab. To break the bond between the frozen dessert and the lid, one depresses the cut tab inwardly with his finger to create a finger opening and then lifts upwardly with the finger. To reopen a partially emptied box, one places a finger within the finger opening and then lifts upwardly with the finger.

4 Claims, 7 Drawing Figures

PRESS TO OPEN
A
B

AID FOR OPENING AND REOPENING OF FROZEN DESSERT BOXES

This application is a continuation-in-part of utility application Ser. No. 488,197, filed Apr. 25, 1983.

BACKGROUND OF THE INVENTION

1. Field of Invention

This invention relates to a consumer aid for opening and reopening of the innermost lid of frozen dessert boxes.

2. Description of the Prior Art

Frozen dessert box design pay little or no attention to consumer convenience. For example, the ice cream box has no aid for the consumer on the innermost lid to open it when it is stuck or bonded to the ice cream. To open the innermost lid, it must be pried loose using a fingernail or some implement such as a knife, fork, or spoon. My invention provides a self-contained means to facilitate the opening and reopening of the innermost lid without increasing the material cost to the box manufacturer by providing a cut tab in the outer edge portion of the innermost lid.

3. Disclosure Statement

I do not know of any ice cream or sherbet box that has a cut tab in its outer edge portion of the innermost lid to facilitate its opening and reopening.

SUMMARY OF THE INVENTION

This invention relates to self-contained means to facilitate opening and reopening of the innermost lid of a frozen dessert box. A cut tab is provided in its outer edge portion of the innermost lid to facilitate the opening and reopening of the innermost lid. The cut tab is located near an outside corner of the innermost lid. If it is deemed desirable to do so, another cut tab may be located near the opposite corner of the innermost lid.

An object of this invention is to provide a cut tab in the outer edge portion of the innermost lid of a frozen dessert box to facilitate its opening and reopening.

Another object of this invention is to provide a cut tab near an outside corner of the innermost lid of a frozen dessert box to facilitate its opening and reopening.

A further object of this invention is to provide two corner cut tabs in the outer edge portion of the innermost lid of a frozen dessert box to facilitate its opening and reopening.

Still another object of this invention is to provide a cut tab in the outer edge portion of the innermost lid of a frozen dessert box to facilitate its opening and reopening, the cut tab includes a curved cut and a scoreline.

A still further object of this invention is to provide a cut tab near an outside corner of the innermost lid of a frozen dessert box, the cut tab includes a curved cut and a scoreline, the curved cut is an incomplete circle and its ends are connected to the scoreline.

Other objects, features and advantages of the present invention will be readily apparent from the following detailed description taken in connection with the accompanying drawing.

DESCRIPTION OF THE PREFERRED EMBODIMENT

Figures 1, 2, 3, 4, 5, 6, 7:
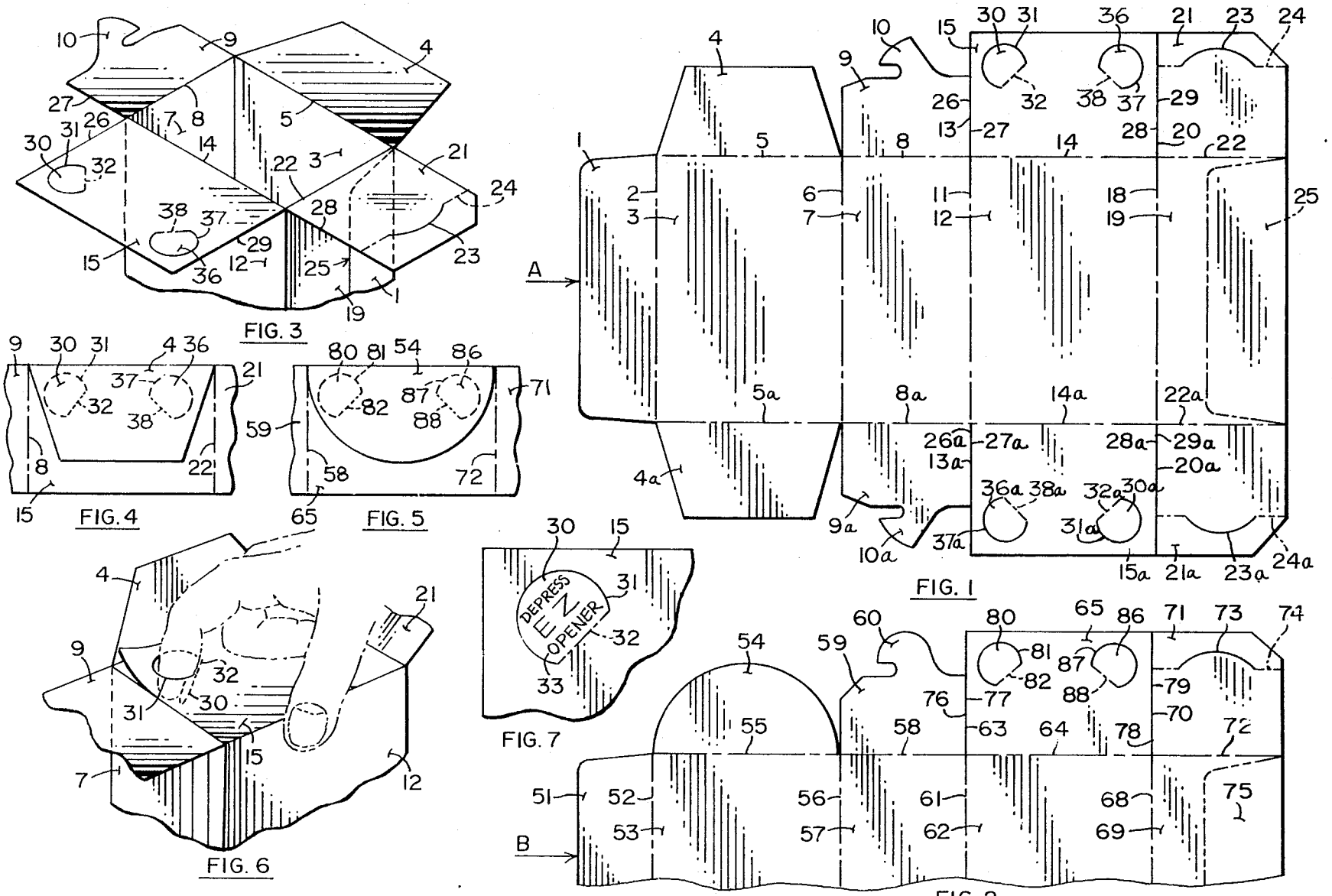
FIG. 1 is a plan view of the outside of blank A which is foldable along the scorelines to form a rectangular box.
FIG. 2 is a fragmentary plan view of the outside of blank B which is foldable along the scorelines to form a rectangular box.
FIG. 3 is a fragmentary perspective view of a rectangular box, formed from blank A of FIG. 1, with lids open and showing the location of two cut tabs in the outer edge portion of the innermost lid.
FIG. 4 is a fragmentary plan view of the rectangular box of FIG. 3 with the inner lid and the innermost lid in closed position and showing the cut tabs covered by the inner lid.
FIG. 5 is a fragmentary plan view of a rectangular box formed from blank B of FIG. 2 with the inner lid and the innermost lid in closed position and showing the cut tabs covered by the inner lid.
FIG. 6 is a fragmentary perspective view of the rectangular box of FIG. 3 showing how my invention is used to open the innermost lid.
FIG. 7 is an enlarged fragmentary plan view of the outside of the innermost lid of the rectangular box of FIG. 3 showing printed opening instruction within a cut tab.

Before explaining the present invention in detail it is to be understood that the invention is not limited in its application to the details of construction and arrangement of parts illustrated in the accompanying drawing, since the invention is capable of other embodiments and of being practiced or carried out in various ways. Also, it is to be understood that the phraseology or terminology employed herein is for the purpose of description and not of limitation.

Referring now to the drawing wherein like reference letters and numerals refer to like and corresponding parts throughout the several views, the preferred embodiment of the invention is disclosed in FIGS. 1, 3, 4, 6, and 7.

The preferred embodiment of the invention includes a one piece blank A foldable along scorelines to form a rectangular box comprising a closer flap 1, scoreline 2, rear panel 3, inner lids 4 and 4*a*, scorelines 5 and 5*a*, scoreline 6, left panel 7, scorelines 8 and 8*a*, outer closer locking lids 9 and 9*a*, locking tabs 10 and 10*a*, scoreline 11, front panel 12, slits 13 and 13*a*, scorelines 14 and 14*a*, innermost lids 15 and 15*a*, scoreline 18, right panel 19, slits 20 and 20*a*, outer closer locking lids 21 and 21*a*, scorelines 22 and 22*a*, locking slits 23 and 23*a*, scorelines 24 and 24*a*, bond area 25, and cut tabs 30, 30*a*, 36 and 36*a*.

Each scoreline is scored for the purpose of folding adjacent parts of the rectangular box. In addition scorelines 24 and 24*a* allow easy entrance of locking tabs 10 and 10*a* into locking slits 23 and 23*a*, respectively.

Reference numerals 26 and 27 represent the edges of slit 13. Reference numerals 26*a* and 27*a* represent the edges of slit 13*a*. Reference numerals 28 and 29 represent the edges of slit 20. Reference numerals 28*a* and 29*a* represent the edges of slit 20*a*.

Cut tab 30 includes a curved cut 31 and a scoreline 32. Cut tab 30*a* includes a curved cut 31*a* and a scoreline 32*a*. Cut tab 36 includes a curved cut 37 and a scoreline 38. Cut tab 36*a* includes a curved cut 37*a* and a scoreline 38*a*. Each cut tab and accompanying score line defines a finger hole, said finger hole is snugly covered until said cut-tab is depressed.

FIG. 7 shows printed opening instruction 33 on cut tab 30. It is contemplated that all of the cut tabs will have printed opening instructions. But except for FIG. 7, the printed opening instruction within each cut tab has been omitted for the sake of clarity. I use the printed opening instruction "DEPRESS E Z OPENER", but any other printed opening instruction may be used.

Each cut tab is located about 3/16 inch (0.48 cm.) from its respective corner of the innermost lid. Each curved cut has a circumference of approximately ⅔ of a complete circle and has its ends connected to a scoreline. The scoreline is inclined at an angle of 45° with either side edge and/or the top edge of the innermost lid. The tongue points in the direction of the outer corner. The area of each cut tab should be large enough to provide ample finger room for a finger opening. I prefer a ⅞ inch (2.2 cm) diameter for the cut tab.

The scoreline of a cut tab acts like a hinge when the cut tab is depressed to create a finger opening and as a reinforcement against tearing the cardboard box during the opening. The use of a scoreline joining the ends of the cut tab is optional.

The cut tabs are positioned so that in a closed position the inner lid 4 will cover the cut tabs. See FIG. 4. The covering of the cut tabs reinforce them against rupture by the ice cream.

I prefer a corner location instead of a central location for the cut tab because: (1) It is easier to displace the ice cream under the cut tab when it is depressed as the ice cream readily bulges to the sides of the box. (2) The pulling force to start the innermost lid to open is greatly reduced as you are disturbing a relatively small area of the innermost lid stuck to the ice cream. Once the seal is broken, the balance of the stuck innermost lid opens easily.

If the cut tab is located in the central portion of the innermost lid with the scoreline parallel to the outer edge, one's effort is employed to open the entire innermost lid with the initial pull. Also it is more difficult to displace the ice cream when depressing the cut tab to form a finger opening as it has only one side of the box to bulge. However, a central cut tab may be used if it is deemed to be desirable to do so.

A cut tab is located in the vicinity of each outer corner of the innermost lid. While two cut tabs are shown in each innermost lid, only one is required. If only one is used, I prefer a cut tab on the right outer corner of each innermost lid as most consumers are left-handed.

Blank B in FIG. 2 is similar to blank A except for the shape of the inner lid, outer closer locking lid, and the locking tab. Blank B includes a closer flap 51, scoreline 52, rear panel 53, inner lid 54, scoreline 55, scoreline 56, left panel 57, scoreline 58, outer closer locking lid 59, locking tab 60, scoreline 61, front panel 62, slit 63, scoreline 64, innermost lid 65, scoreline 68, right panel 69, slit 70, outer closer locking lid 71, scoreline 72, locking slit 73, scoreline 74, bond area 75, and cut tabs 80 and 86.

Reference numerals 76 and 77 represent the edges of slit 63. Reference numerals 78 and 79 represent the edges of slit 70.

FIG. 5 shows inner lid 54 covering cuts tabs 80 and 86 to reinforce them against rupture by the ice cream.

To open a new and full box of ice cream with my invention the following steps are suggested: (1) Unlock outer closer locking lids 9 and 21. (2) Fold back inner lid 4. (3) Depress cut tab 30 inwardly approximately 30° with a finger, thereby displacing the ice cream beneath the cut tab and creating a finger opening. (4) Lift upward with finger to break the bond between the innermost lid 15 and the ice cream. See FIG. 6. The ice cream is ready for dispensing.

To store a partially emptied box of ice cream with my invention, prior to closing the box after its initial opening, bend back cut tab 30 to close the finger opening, then: To reopen container (1) Unlock outer closer locking lids 9 and 21. (2) Fold back inner lid 4. (3) Depress cut tab 30 inwardly with a finger to create a finger opening. (4) Lift upward with finger to open innermost lid 15. The ice cream is ready for dispensing.

My invention provides a self-contained means to facilitate the opening and reopening of the innermost lid of ice cream or sherbet boxes without increasing the material cost to the box manufacturer. Yet at the same time, it requires little alteration to the blanking die and no alteration to the filling machine. The fact that there need be no alteration to the filling machine will result in the saving of thousands of dollars and more importantly a saving in time. Moreover, my invention will be used by the consumer as its use will be quickly learned and utilized.

Although but a single embodiment of the invention has been disclosed and described herein, it is obvious that many changes may be made in the size, shape, arrangements, color and detail of the various elements of the invention without departing from the scope of the novel concepts of the present invention.

I claim as my invention:

1. A rectangular carton for containing a frozen dessert, said carton comprising opposing front and back walls, two opposing side walls, and opposing top and bottom closure walls, each closure wall including an innermost closure flap entirely in contact with the frozen dessert to be contained in the carton, and at least one additional flap covering each said innermost flap, said innermost flap having at least one depressible tab to define a finger hole for breaking the bond created between the frozen dessert and said innermost flap so that said innermost flap may be lifted, said tab covering said holes prior to being depressed.

2. The carton of claim 1, wherein an opening instruction is printed on the depressible tab and surrounding area.

3. A rectangular carton for containing a frozen dessert, said carton comprising opposing front and back walls, two opposing side walls, and opposing top and bottom closure walls, each closure wall including an innermost closure flap entirely in contact with the frozen dessert to be contained in the carton, and at least one additional outer flap covering each of said innermost flaps, said innermost flaps having at least one depressible cut tab to define a finger hole for breaking the bond created between the frozen dessert and said innermost flaps so that said innermost flaps may be lifted, said tabs covering said defined finger holes prior to being depressed.

4. The carton of claim 3 wherein an opening instruction is printed on the depressible tabs and their accompanying surrounding areas.

* * * * *